United States Patent [19]

Stomp et al.

[11] Patent Number: 4,883,259

[45] Date of Patent: Nov. 28, 1989

[54] APPARATUS FOR COUPLING A METALLURGICAL LADLE TO A GAS SUPPLY

[75] Inventors: Hubert Stomp, Howald/Grand-Duchy; Jean-Pierre Barthel, Oberanven; Albert Feitler, Strassen; Fred Parasch, Schifflange, all of Luxembourg

[73] Assignee: Paul Wurth S.A., Luxembourg, Luxembourg

[21] Appl. No.: 284,920

[22] Filed: Dec. 15, 1988

[51] Int. Cl.[4] ..... C21C 5/46

[52] U.S. Cl. ..... 266/217; 266/265

[58] Field of Search ..... 266/217, 218, 219, 220, 266/221, 222, 223, 224, 265, 266, 267, 268, 269, 270, 287

[56] References Cited

U.S. PATENT DOCUMENTS 4,502,670 3/1985 Goebel et al. ..... 266/265

*Primary Examiner*—2

*Assistant Examiner*—Robert McDowell

*Attorney, Agent, or Firm*—Fishman, Dionne & Cantor

[57] ABSTRACT

An apparatus for coupling a metallurgical ladle to a gas supply is presented wherein gas is used for the treatment of molten metal contained in the ladle. The gas is injected through the bottom of the ladle into the liquid metal. The ladle rests on a support located at a treatment station. The apparatus comprises a base mounted on the bottom of the ladle support in a manner as to be slidable in two directions at right angles to one another against the action of springs. The apparatus is provided with a male connection head which has an axial through passage that communicates with the gas supply. This apparatus also includes a foot fixed on the ladle which is provided with a female connection member for engagement on the connection head when the ladle is placed in its support.

11 Claims, 4 Drawing Sheets

APPARATUS FOR COUPLING A METALLURGICAL LADLE TO A GAS SUPPLY

BACKGROUND OF THE INVENTION

The present invention relates to an apparatus for coupling a metallurgical ladle to a gas supply for the treatment of molten metal contained in the ladle. The gas is injected through the bottom of the ladle into the liquid metal. The gas is injected at a treatment station in which the ladle, is for this purpose, placed on a support.

The treatment of steel, for metallurgical requirements, by injecting a gas into the ladles containing the liquid metal is well known in the prior art. This injection is effected at a treatment station, where the gas is passed through a porous part of the ladle bottom. The porous bottom allows the gas to pass while retaining the liquid metal.

The connection to the gas supply is generally made by hand. It will be appreciated that, because of the environment, this hand connection operation entails the risk of accidents. The hand connection also constitutes a waste of time.

Semi-automatic coupling has been proposed as a method to avoid manual connection of the gas supply. In this method, a coupling head is connected through the action of a jack to one of the side suspension trunnions of the ladle. The trunnion is connected by internal passages and an external duct to the porous bricks of the ladle bottom. Because the trunnion must be specially designed for connection to this coupling head, this system cannot be applied to existing ladles. In addition, depending on the design of the treatment station, lateral access to the ladle may be difficult or even impossible.

SUMMARY OF THE INVENTION

The above discussed and other problems and disadvantages of the prior art are overcome or alleviated by the coupling apparatus of the present invention. The apparatus of the present invention provides a coupling device which will permit entirely automatic connection to the gas supply by placing a ladle in position on the ladle bogie.

A preferred embodiment of the coupling apparatus of the present invention comprises a base mounted on the bottom of a support in a manner which allows it to slide in two directions at right angles to one another against the action of springs. The apparatus of the present invention is provided with a male connection head having an axial through passage communcating with the gas supply. The present invention also includes a foot fixed on the ladle and is provided with a female connection member for engagement on the connection head when the ladle is placed in its support.

The female member is preferably mounted in the foot. In this manner, it is vertically slidable therein under and against the action of a spring provided inside the foot and around the body of the female member.

In another embodiment of the present invention, the connection head is in the form of a cone having a rounded apex. The female member of this embodiment is in the form of a conical bowl open at the bottom. This female member is wider than the head, and has a crown, rounded to compliment the curvature of the apex of the connection head.

The interior of the connection head preferably contains a valve which is intended to sever communication with the gas supply under the action of a spring. The valve is acted on by a plunger passing through the passage in the connection head. The penetration of the plunger into the head, through the action of the engagement of the female member on the connection head, opens the valve against the action of its spring.

This dévice of the present invention consequently permits automatic coupling to the gas supply without manual intervention and without any manual operation other than the simple placing of the ladle on the support. The slidability of the connection head in two directions at right angles to one another, in conjunction with the special shape of the connection members, permits self-alignment and self-centering of said members through the sliding of the base on the support. This makes it possible to compensate for small defects in the alignment of the members which are to be coupled to one another.

In a first embodiment of the present invention, the bottom of the base is in the form of a cavity which has vertical walls and a rectangular or square section, slidingly bearing against a support block which is fastened to the bottom of the bogie. Two sets of rods, superimposed and disposed in the form of a cross, are adapted to slide through the block. The rod ends are provided with shoes slidingly bearing respectively against the opposite inside walls of the cavity. At least one of each set of rods is preferably surrounded by two springs respectively bearing against the outer shoes and the block. This ensures a neutral central position of the rods.

In a second embodiment of the present invention, the base is carried by a seat in which it is slidable in a first direction around guide rods which pass through it and which are fixed in the seat. The latter is carried in a frame which is fixed to a bogie. In this manner, it is slidable in a second direction, at right angles to the first, around guide rods fixed in the wall of the frame. The base and its seat are preferably held by springs in a neutral central position relative to the frame.

The above-discussed and other features and advantages of the present invention will be apparent to and understood by those skilled in the art from the following detailed description and drawings.

BRIEF DESCRIPTION OF THE DRAWINGS

Referring now to the drawings, wherein like elements are numbered alike in the several FIGS.

DESCRIPTION OF THE PREFERRED EMBODIMENT

Figures 1, 2:
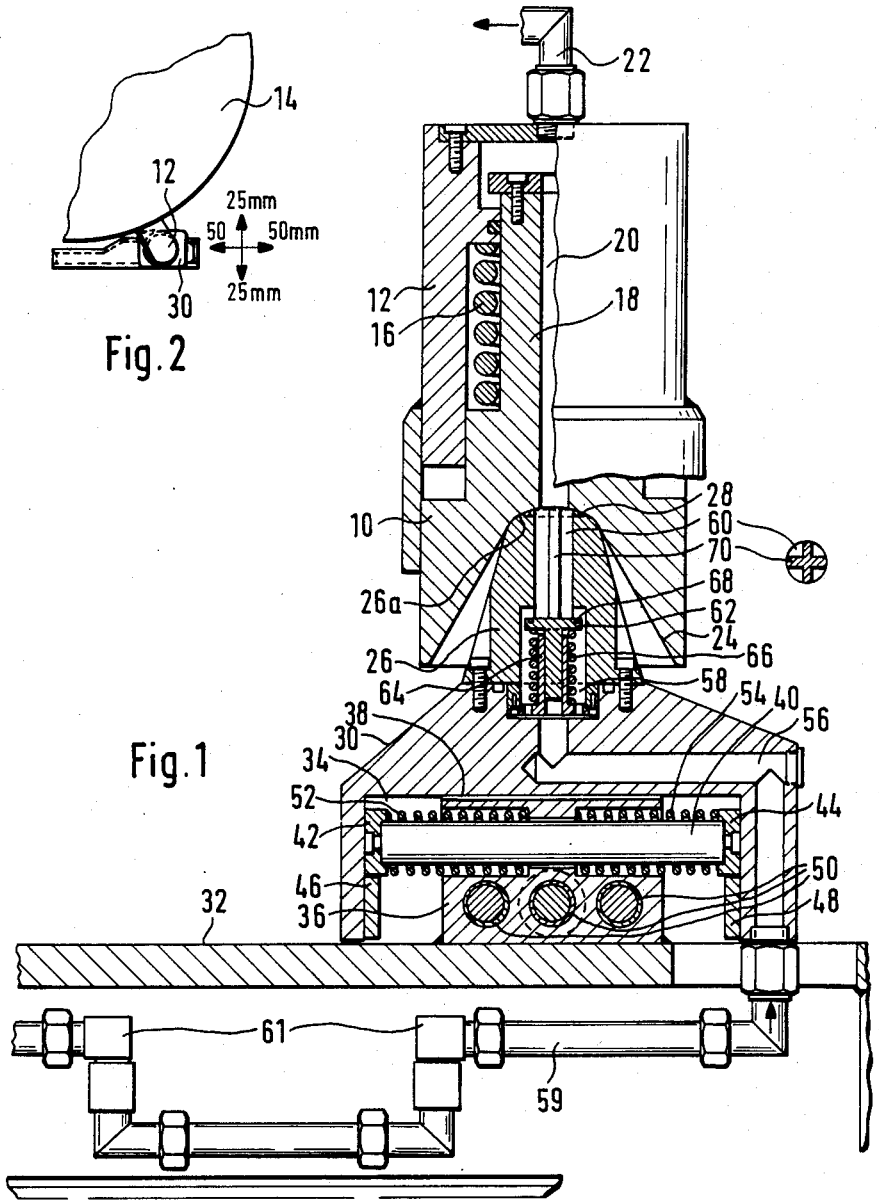
FIG. 1 is a partial cross-sectional, side elevational view of the coupling apparatus of the present invention.
FIG. 2 is a partial plan view which shows the arrangement of the apparatus of FIG. 1 in conjunction with a pouring ladle.

Referring first to both FIGS. 1 and 2, the apparatus of the present invention is shown. In FIG. 1, a female connection member 10 is telescopically mounted in a foot 12. Foot 12 is fixed to the bottom part of the outer wall of a metallurgical ladle 14, as shown in FIG. 2. Member 10 can be driven a predetermined distance into foot 12. Member 10 is driven against the action of a helical spring 16 disposed around a body 18 of member 10 and bearing respectively against an internal shoulder on foot 12 and an external shoulder on body 18. Member 10 has an axial through passage 20 in communication with an external pipe 22 which connects foot 12 to the hollow part of the bottom of ladle 14. The bottom part of connection member 10 comprises a bowl 24 of generally conical shape, open at the bottom and having a rounded crown.

Bowl 24 serves to receive a male connection head 26, which is likewise conical in shape but has a greater inclination than the conicity of bowl 24. Connection head 26 has a rounded apex corresponding to the curvature of the crown of bowl 24, so as to match the shape of bowl 24. An O-ring seat 28, provided on apex 26*a* of head 26, ensures leak resistance when member 10 and head 26 are coupled together as shown in FIG. 1.

Head 26 is mounted on a base 30 carried by a bottom 32 of the support of ladle 14. In accordance with the present invention, base 30 has two horizontal degrees of freedom in relation to support 32.

In a first embodiment of the present invention shown in FIG. 1, base 30 has a bottom open-ended cavity 34 of rectangular or square section, with vertical inside walls. Base 30 is engaged by cavity 34 on a support block 36 fastened to bottom 32 of the support. The top surface of this block 36 is preferably provided with a top sliding layer 38. Layer 38 carries base 30 while permitting relatively easy sliding of base 30 on block 36.

In order to ensure the necessary stability of base 30, a guide system is provided in cavity 34 to hold it relative to support block 36. A first set of rods 40 is slidably housed in block 36. First set of rods 40 is provided at its opposite ends with two shoes 42 and 44 sliding on the opposite vertical walls of base 30. A pair of stops 46 and 48 function to prevent the inopportune lifting of base 30. Base 30 can slide in a direction at right angles to the plane of FIG. 1 by relative movements between shoes 42 and 44, and guide surfaces 46 and 48 on base 30.

A second set of rods 50 is disposed at right angles to first set of rods 40. Second set of rods 50 has shoes (not shown) bearing against the vertical walls (not visible in FIG. 1) of base 30. The shoes of rods 50 permit displacement of base 30, to the left and right in FIG. 1, through the sliding of rod 40 in support block 36.

In order to ensure a central position of base 30, at least one of each set of rods 40 and 50 is surrounded by two helical springs 52 and 54. Springs 52 and 54 bear respectively against block 36 and each of the two external shoes 42 and 44. In other words, the sliding of base 30, in the plane of FIG. 1, is effected against the action of one of springs 52 and 54. The sliding in the direction at right angles, to the plane of FIG. 1, is effected against the action of springs surrounding second set of rods 50.

The combination of these two possibilities of movement enables base 30 to occupy any position in a quadrilateral, whose area is defined by the amplitude of the freedom of movement. FIG. 2 clearly illustrates schematically these freedoms of movement, in the form of the arrow representing a rectangle of freedom of movement whose slides are 50 by 100 millimeters.

Base 30 is also provided with an internal duct 56, for the admission of gas for the treatment of the liquid metal contained in ladle 14. Duct 56 is connected to an articulated or flexible pipe 59 which forms part of the gas distribution system. Pipe 59 is provided with rotatable joints 61 which permit the movements of base 30 on the bottom of support 32 of the bogie.

Duct 56 leads into a chamber 58 provided in the top part of base 30 and in the interior of connection head 26. Chamber 58 is extended by an axial passage 60 to apex 26*a* of head 26. Chamber 60 contains an automatic valve, automatically interrupting or establishing communication with pipe 59 of the gas distribution system. This valve consists of a piston 62 sliding axially in a guide sleeve 64. Sleeve 64 is surrounded by a spring 66 whose action applies piston 62, which is provided with an O-ring seal 68, against a shoulder formed between chamber 58 and passage 60 to close the valve. The opening of the valve against the action of spring 66 is effected with the aid of a plunger 70 disposed in passage 60 and resting free on piston 62. Plunger 70 has an appropriate cross-section in order to allow for the passage of the gas, for example a cruciform shape as shown in the inset. The length of plunger 70 is slightly greater than that of passage 60. Thus the top end of plunger 70 projects beyond the apex of head 26 when the valve is closed. In this configuration, plunger 70 can be driven into piston 62 in order to open the valve, as shown in FIG. 1. This is accomplished by the placement of head 26 against member 10.

The apparatus of the present invention utilizes the movement of the ladle to bring about the automatic connection to the gas supply. When foot 12 is lowered in the direction of the base 30. Members 10 and 26 are self-centered by the sliding of base 30 on its support. This self-centering begins with the penetration of head 26 into bowl 24. The complimentary curvatures of apex 26*a* of head 26 and of the crown of bowl 24 also make it possible to compensate for small defects in alignment. Before the coupling position shown in FIG. 1 is reached, the automatic valve is opened by the driving-in of plunger 70 as soon as plunger 70 is contacted by the crown of bowl 24. The connection is final when a slight penetration of connection member 10 into foot 12 against the action of spring 16 occurs.

Similarly, when ladle 14 is removed from its support, the disengagement of member 24 from head 26 frees plunger 70. Plunger 70 is subject to the action of spring 66, to close the valve and automatically interrupt communication with the gas supply.

Figure 3:
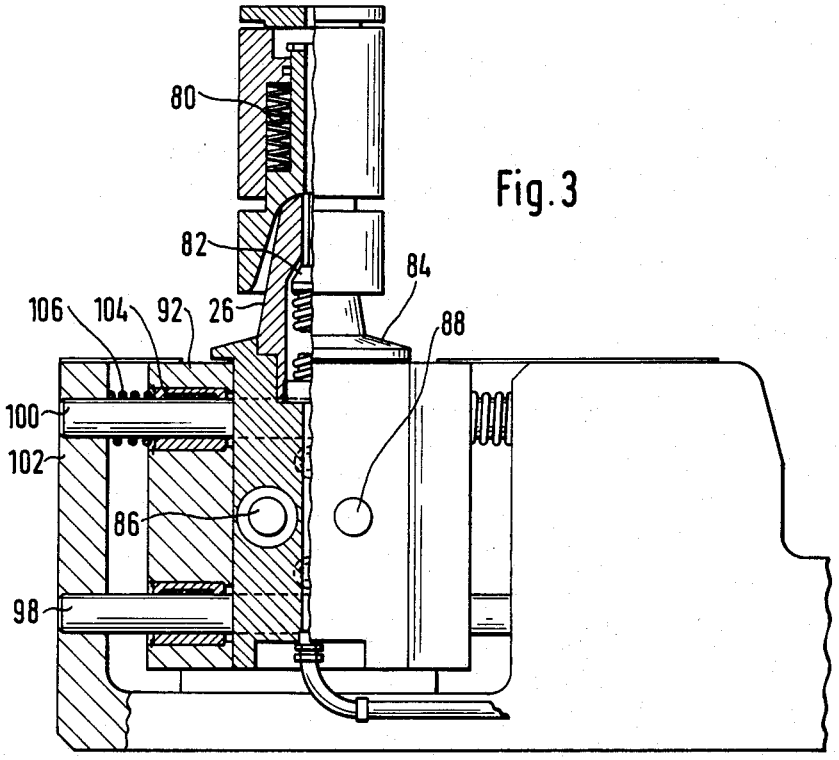
FIG. 3 is a partial cross-sectional side elevation view of an alternate embodiment of the apparatus of FIG. 1.
Figure 4:
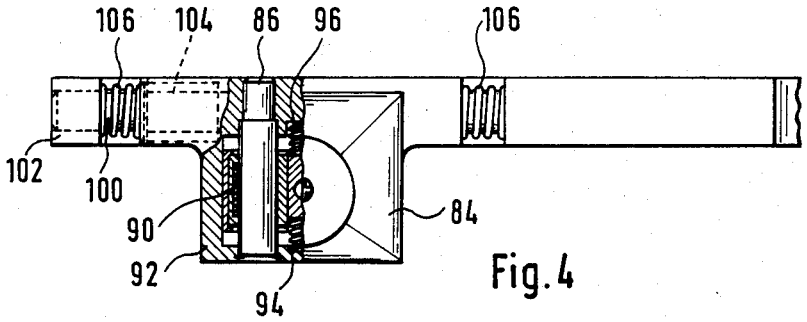
FIG. 4 is a top elevation, partial cross-sectional view of the apparatus of FIG. 3.

In the alternate embodiment illustrated in FIGS. 3 and 4, the coupling members are the same as those in the embodiment shown in FIG. 1. The primary difference between the embodiments of FIGS. 3 and 4, and FIGS. 1 and 2 is that helical spring 16 has been replaced by a disc spring 80 and that flat headed piston 62 of the automatic valve has been replaced by a conical piston 82. Another difference in the alternate embodiment shown in FIGS. 3 and 4 is the mounting of base 84 of connection head 26 in order to provide two degrees of freedom in relation to the floor of the support. For this purpose, base 84 is carried by two rods 86 and 88, which pass through it and are fastened to a seat 92 surrounding base 84. Base 84 can slide axially on these rods 86 and 88 because of the presence of ball bushing 90 around each of rods 86 and 88. The central position of base 84 in seat 92 is achieved with the aid of springs 94 and 96 disposed one on each side of base 84 and bearing against seat 92.

The assembly, formed by base 84 and seat 92, is then carried by two superimposed rods 98 and 100 which pass through the assembly. The assembly is fastened to a frame 102 fixed on the floor of the ladle support. The sliding of base 84 and seat 92 to the left and to the right in FIG. 3 is facilitated by ball bushing 104 disposed around rods 98 and 100 at the positions where they pass through seat 92. The central position of seat 92 in relation to frame 102 is obtained with the aid of springs 106. Springs 106 are provided on at least one of rods 98 or 100, one on each side of seat 92, and bearing against frame 102. The mounting device shown in FIGS. 3 and 4 consequently enables base 84 to slide in two directions at right angles to one another, as in the embodiment shown in FIGS. 1 and 2. That is, in a first direction in relation to its seat 92 and in a direction at right angles to said first direction, together with its seat in relation to frame 102.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. An apparatus for coupling a metallurgical ladle to a gas supply for treatment of molten metal contained in the ladle wherein gas is injected through the bottom of the ladle into the liquid metal at a treatment station and wherein the ladle rests on a ladle support, comprising:

base means mounted on said ladle support;

spring means associated with said base means to slide said base means in at least first and second directions, said first and second directions being mutually transverse to one another;

male connection head means having an axial passage therethrough, said male connection head means including means for communicating with a gas supply;

foot means for attachment to the ladle; and female connection member means for engagement on said male connection head means when said ladle is positioned on said ladle support.

2. The apparatus of claim 1 including:

vertical spring means inside said foot means and surrounding said female member means, said female member means being mounted in said foot means wherein said female member means slide vertically under the action of said vertical spring means.

3. The apparatus of claim 1 wherein:

said male connection head means is in the shape of a cone having a rounded apex; and said female connection member means is in the shape of a conical bowl open at the bottom, said conical bowl being wider than said cone shaped head means and said conical bowl having a rounded crown to compliment the curvature of said apex of said cone shaped connection head means.

4. The apparatus of claim 3 including:

at least one O-ring seal means at said apex of said male connector head means.

5. The apparatus of claim 3 including:

valve means within said connection head means for severing communication with the gas supply;

valve spring means for actuating said valve means;

plunger means positioned through a passage in said connection head means, said plunger means being urged against said valve means under the action of said valve spring means wherein the penetration of said plunger means into said head means results from engagement of said female member means on said connection head means to thereby open said valve means against the action of said valve spring means.

6. The apparatus of claim 1 including:

Pipe means having rotatable joint means which connect said base means to the gas supply.

7. The apparatus of claim 1 wherein said base means has a bottom in the shape of a cavity having vertical inside walls and a rectangular square section; and including:

support block means fastened to the bottom of said ladle support, said cavity of said base means slidably resting on said support block means a plurality of sets of rod means, said rods means having opposed ends, said rod means being slidable through said block means; and shoe means on said ends of said rod means, said shoe means slidingly bearing respectively against opposite inside walls of said cavity.

8. The apparatus of claim 7 including:

at least two rod springs means surrounding at least one of each set of rod means, said rod spring means respectively bearing against said shoe means and said block means to ensure a neutral central position of said base means.

9. The apparatus of claim 7 wherein:

said sets of rod means are transverse to one another.

10. The apparatus of claim 1 including:

seat means for carrying said base means, said seat means including means for sliding said base means in a first direction around first guide rod means which pass through and which are fixed in said seat means; and frame means for carrying said seat means, said frame means being fixed to said ladle support means, said seat means being slidable in a second direction, at right angles to said first direction, around second guide rods fixed to said wall of said frame means.

11. The apparatus of claim 10 including:

seat spring means between said base means and said seat means, and between said seat means and said frame means said base means and said seat means being held in a neutral central position relative to said frame means under the action of said seat spring means.

* * * * *